US007821467B2

(12) United States Patent
Sugiyama

(10) Patent No.: US 7,821,467 B2
(45) Date of Patent: Oct. 26, 2010

(54) TUNABLE ANTENNA MODULE WITH FREQUENCY CORRECTION CIRCUIT AND MANUFACTURING METHOD THEREOF

(75) Inventor: Takahiro Sugiyama, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 64 days.

(21) Appl. No.: 12/195,546

(22) Filed: Aug. 21, 2008

(65) Prior Publication Data

US 2009/0051610 A1 Feb. 26, 2009

(30) Foreign Application Priority Data

Aug. 22, 2007 (JP) ..... 2007-215743

(51) Int. Cl.
*H01Q 9/00* (2006.01)

(52) U.S. Cl. ..... 343/745

(58) Field of Classification Search ..... 343/745, 343/860, 702

See application file for complete search history.

(56) References Cited

U.S. PATENT DOCUMENTS 4,381,566 A * 4/1983 Kane ..... 455/193.3
4,754,265 A * 6/1988 Henderson et al. ..... 340/653
6,054,965 A * 4/2000 Yamamoto ..... 343/860
6,606,069 B2 * 8/2003 Kitamura et al. ..... 343/745
7,145,509 B2 * 12/2006 Ikuta et al. ..... 343/700 MS
7,253,781 B2 * 8/2007 Furuhi et al. ..... 343/753
7,375,695 B2 * 5/2008 Ishizuka et al. ..... 343/745
2006/0279469 A1 12/2006 Adachi et al.
2009/0245425 A1 * 10/2009 Tsutsui et al. ..... 375/319

FOREIGN PATENT DOCUMENTS

JP 10-173426 6/1998
JP 2000-151448 5/2000
JP 2003-298341 10/2003
JP 2006/345042 12/2006
JP 2006-345042 12/2006

* cited by examiner

*Primary Examiner*—Huedung Mancuso
(74) *Attorney, Agent, or Firm*—Antonelli, Terry, Stout & Kraus, LLP.

(57) ABSTRACT

A tunable antenna module with frequency correction circuit having an antenna element, a variable capacity means connected to the antenna element, and a frequency control source that generates a controlling voltage for varying the capacity of the variable capacity means to vary a tuning frequency according to the frequency of radio wave received by the antenna element. The module further has a voltage divider circuit comprised of resisters for dividing the controlling voltage, and connected between the frequency control source and the variable capacity means. The tuning frequency is corrected by the voltage divider circuit.

7 Claims, 4 Drawing Sheets

TUNABLE ANTENNA MODULE WITH FREQUENCY CORRECTION CIRCUIT AND MANUFACTURING METHOD THEREOF

BACKGROUND OF THE INVENTION

This invention relates to a tunable antenna module and a manufacturing method thereof, in which the capacity of a variable capacity means connected to an antenna element is changed by the control voltage of a frequency control source, and a tuning frequency is changed according to the frequency of an electric wave received by the antenna element.

The digital terrestrial broadcasting is the television broadcasting performed by using a radio station of a ground digital method. It is scheduled to replace analog television broadcasting (VHF 1-12 ch) started in 1953 with a digital method in which only UHF channels (470-770 MHz band and 13-62 ch) will be used in July 2011 in Japan.

In the digital terrestrial broadcasting, a multi-channel OFDM (Orthogonal frequency division multiplex) method is used. Therefore, it is possible to make different digital modulation in each segment by dividing the career into 13 segments.

A usual television, a computer such as a desktop type computer and a notebook-sized personal computer can provide four channels for three segments. Moreover, 12 segments are used in a high definition broadcasting, and the remaining segment is used to broadcast one segment television (partially receiving service of one segment for a cellular phone or a mobile terminal for data transmission. The reception of one-segment television has aimed at use with mobile and portable equipment such as a cellular phone, car-navigating equipment, PDA (a personal digital assistance), and a game machine.

There is a monopole antenna or a conventional tunable antenna module 71 shown in FIG. 7 as an antenna which can receive such digital terrestrial broadcasting.

In tunable antenna module 71, variable capacitance diode (VCD) 73 is connected with wave receiving element 72. VCD is also called a varicap diode or a variable condenser. Capacitor 74 for cutting off a DC (direct current) is connected with VCD 73. Resistance 75 for cutting off an RF (radio frequency) is connected between for VCD 73 and DC cutting-off capacitor 74. Frequency control source 76 is connected with a power supply side terminal of resistance 75 for cutting off the radio frequency.

The capacity of VCD 73 is changed by a control voltage of frequency control source 76, and the tuning frequency is changed according to the frequency of the electric wave received by wave receiving element 72. Thereby, the broadcasting in the desired channel is received in this tunable antenna module 71.

The prior art which relates to the present invention is disclosed in the following documents.

(1) JP10-173426A (Tune type, especially FIG. 2).
(2) JP2000-151448A (Tune type)
(3) JP2003-298341A (Tune type, especially FIG. 3).
(4) JP2006-345042A (Microcomputer control type)

BRIEF SUMMARY OF THE INVENTION

Because VCD 73 is a semiconductor device, the carrier density in each of semiconductor layers which compose the semiconductor device is different. Therefore, the difference not avoided in VCD 73 is occurred in applied voltage-electrostatic capacity characteristic. The control voltage value usually set beforehand is set in frequency control source 76.

Therefore, the difference is caused in the tuning frequency which is one of antenna characteristics in conventional tunable antenna module 71 which uses VCD 73 due to the difference of the above-mentioned applied voltage-electrostatic capacity characteristic.

Moreover, because the tunable antenna is used generally for narrow band (For instance, because the length of the antenna is short, the wave receiving element is made to tune in its narrow portion when installing the tunable antenna in a cellular phone and a notebook type personal computer), there is a problem that receiving characteristics deteriorates remarkably when the tuning frequency shifts.

In addition, when conventional tunable antenna module 71 is used to receive digital terrestrial broadcasting, it is required to maintain the receiving characteristics in overall bandwidth of 470-770 MHz as shown in FIG. 8 (Example of a general monopole antenna). Therefore, when the broadcasting in the desired channel is received, the difference of the tuning frequency is connected directly with the deterioration in the receiving characteristics.

An object of the present invention is to provide a tunable antenna module with frequency correction circuit which reduces the difference of antenna characteristics such as the tuning frequency, etc.

In one aspect of the present invention, a tunable antenna module with frequency correction circuit comprises: an antenna element, a variable capacity means connected to the antenna element, and a frequency control source that generates a controlling voltage for varying the capacity of the variable capacity means to vary a tuning frequency according to the frequency of radio wave received by the antenna element. The tunable antenna module further comprises; a voltage divider circuit comprised of resisters for dividing the controlling voltage, and connected between the frequency control source and the variable capacity means. Where, the tuning frequency is corrected by the voltage divider circuit.

Preferably, in the tunable antenna module with frequency correction circuit, the voltage divider circuit includes a circuitry comprised of: a series connection of a first resistor having a power supply terminal thereon and a second resistor having a grounding terminal thereon, a value of resistance of the second resistor being larger than that of the first resistor; a connection of the power supply terminal of the first resistor to the frequency control source; a connection of the grounding terminal of the second resistor to ground; and a parallel connection of the variable capacity means to the intermediate connection point of the series connection of the first resistor and the second resistor.

Preferably, in the tunable antenna module with frequency correction circuit, values of resistances of the first and second resistors are determined according to C-V (Capacitance-Reverse Voltage) characteristics of the variable capacity means.

More preferably, in the tunable antenna module with frequency correction circuit, resistance values of the first and second resistors are determined based on a sample value obtained by sampling the variable capacity means in each production lot of the variable capacity means, measuring electrostatic capacity of the sampled variable capacity means, and averaging values measured Preferably, in the tunable antenna module with frequency correction circuit, the variable capacity means is a variable capacitance diode or a MEMS variable capacitor (a microelectromechanical system variable capacitor).

Preferably, in the tunable antenna module with frequency correction circuit, the resistor is a fixed resistance or a copper foil pattern for trimming.

Another aspect of the present invention is a method of manufacturing a tunable antenna module with frequency correction circuit. The manufacturing method comprises: an antenna element; a variable capacity means electrically connected to the antenna element; a frequency control source that generates controlling voltage for varying the capacity of the variable capacity means; a voltage divider circuit that includes the voltage divider circuit includes a circuitry comprised of a series connection of a first resistor having a power supply terminal thereon and a second resistor having a grounding terminal thereon, wherein a value of resistance of the second resistor is larger than that of the first resistor, a connection of the power supply terminal of the first resistor to the frequency control source, a connection of said grounding terminal of said second resistor to ground, and a parallel connection of the variable capacity means to the intermediate connection point of the series connection of the first resistor and the second resistor; which comprises the steps of: sampling the variable capacity means from each production lot of the variable capacity means; measuring electrostatic capacity of the sampled variable capacity means; averaging measurements obtained in the measuring to calculate an average electrostatic capacity of the variable capacity means for each of the production lots; discriminating a production lot of the variable capacity means, of which average electrostatic capacity is as predetermined, from other production lot of the variable capacity means, of which average electrostatic capacity is not as predetermined; calculating a drift X (%) of average electrostatic capacitances between the variable capacity means in the production lot, of which average electrostatic capacity is as predetermined, and the variable capacity means in the other production lot, of which average electrostatic capacity is not as predetermined, using formula (1); calculating a resistance value r1 by applying the resistance value of the first resistor r0, the resistance of the second resistor R0, and the drift x in average electrostatic capacitances to formula (2). Where, the tunable antenna module is manufactured by using the first resistor of which resistance value is the calculated resistance value of r1, the second resistor of which resistance value is the resistance value R0, and the variable capacity means of which electrostatic capacity characteristics is not as predetermined.

$$X=[(\text{Average electrostatic capacity of variable capacity means of each of production lots})-(\text{Average electrostatic capacity predetermined for variable capacity means})]\times 100/(\text{Average electrostatic capacity predetermined for variable capacity means}) \quad (1)$$

$$r1=r0+R0\times(x/100) \quad (2)$$

The difference of antenna characteristics such as a tuning frequency etc. can be reduced according to the present invention.

DETAILED DESCRIPTION OF THE PREFERRED EMBODIMENTS

Hereafter, preferred embodiments of the present invention are explained with reference to attached drawings.

Figure 1:
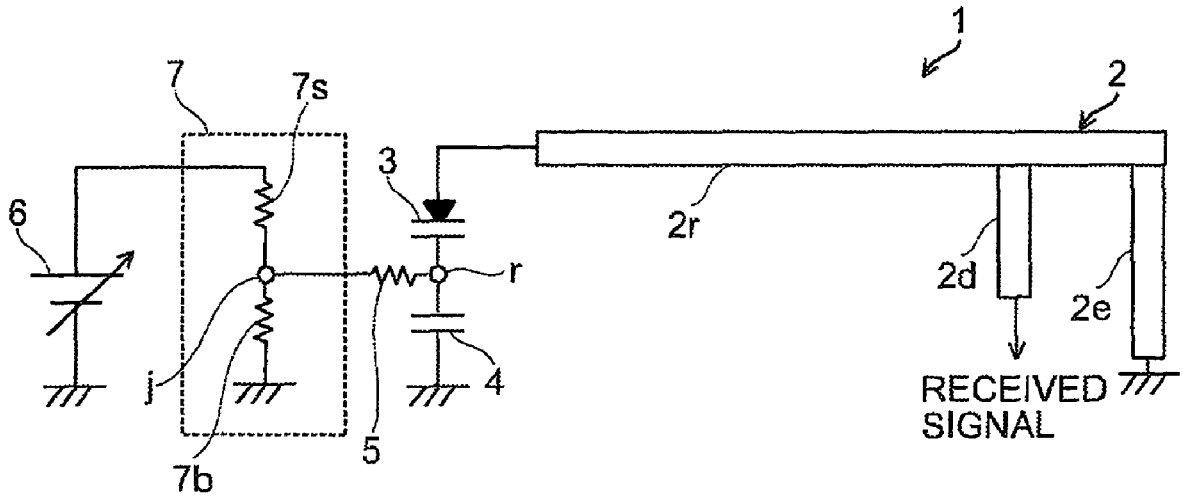
FIG. 1 is a circuit diagram showing a tunable antenna module with frequency correction circuit according to the preferred embodiment of the present invention.

FIG. 1 is a circuit diagram showing a tunable antenna module with frequency correction circuit according to the preferred embodiment of the present invention.

Tunable antenna module with frequency correction circuit 1 according to the embodiment (It is only said the tunable antenna module as follows) is installed in mobile and portable equipment such as a desktop type or notebook type computer, a cellular phone, car-navigating equipment, PDA (a personal digital assistance), and a game machine in order to receive digital terrestrial broadcasting mainly as shown in FIG. 1. Additionally, tunable antenna module 1 can be used as an receiving antenna.

In this tunable antenna module 1, variable capacity means 3 is connected with wave receiving element 2 which is an antenna element. In this embodiment, VCD is used as variable capacity means 3. Wave receiving element 2 is formed with conductive metal plate such as Cu, Al, etc. or a microstrip line installed on a printed circuit substrate (PCB).

In this embodiment, the antenna element in which a metal plate is formed to approximate F-shape in plan is used as wave receiving element 2. Wave receiving element 2 is composed of elongated receiving part 2*r*, ground part 2*e* of which the point is earthed, protruded in the side from one end of receiving part 2*r*, and feeding part 2*d* protruded along ground part 2*e* from a side edge of receiving part 2*r*, for feeding an electric wave to a receiving circuit. A coaxial cable (not shown) of a minute diameter and a printed circuit substrate are connected with the point of feeding part 2*d*.

An anode of variable capacity means 3 is connected in series with the other edge of receiving part 2*r* of wave receiving element 2. A cathode of variable capacity means 3 is connected in series with one terminal of capacitor 4 for cutting off a DC. The other terminal of capacitor 4 is earthed. An terminal on the side of wave receiving element 2 of resistor 5 for cutting off an RF is connected in parallel between variable capacity means 3 and capacitor 4. In this embodiment, the resistance of resistor 5 for cutting off an RF is 100 kΩ. The tuning circuit is composed of variable capacity means 3, capacitor 4 for cutting off a DC and resistor 5 for cutting off an RF.

As a variable DC power supply for applying a reverse voltage of a frequency control voltage to variable capacity means 3, the positive terminal (frequency control voltage terminal) of frequency control source 6 is connected in series with a power supply side terminal of resistor 5 for cutting off an RF through voltage divider circuit 7 composed of resistors.

Ranges of the frequency control voltage of frequency control source 6 are 0-6V for digital terrestrial broadcasting. Moreover, the electrostatic capacity of variable capacity means 3 changes within the range of about 1.0-4.5 pF according to this frequency control voltage.

Voltage divider circuit 7 divides the frequency control voltage to function as a frequency correction circuit. This voltage divider circuit 7 comprises resistor 7*s* (a first resistor) having a small resistance, which adjusts the resistance to be divided, and resistor 7*b* (a second resistor) connected in series with resistor 7*s*, which operates as a resistor for dividing voltage whose resistance is larger than that of resistor 7*s*. Where, the positive terminal of frequency control source 6 is connected with a power supply side terminal of small resistor 7*s*. An earth side terminal of resistor 7*b* is grounded. Node j of resistor 7*s* and resistor 7*b* is connected in parallel with the cathode of variable capacity means 3 through resistor 5 for cutting a RF.

As described later in a manufacturing method, variable capacity means 3 from each production lot of variable capacity means 3 is sampled first to set the resistance of resistor 7*s* and resistor 7*b*. Second, electrostatic capacity of sampled variable capacity means 3 is measured, and the electrostatic capacity measured is averaged. Lastly, the resistance of resistor 7*s* and resistor 7*b* is set so that electrostatic capacity of sampled variable capacity means 3 may become a desired value by adjusting the divided voltage of the frequency control voltage applied to variable capacity means 3 based on the sampling value obtained thus. Because, electrostatic capacity of each production lot of variable capacity means 3 varies.

In this embodiment, the resistance of resistor 7*s* is set to 0-50 kΩ, preferably 0-20 kΩ, and the resistance of resistor 7*b* is set to 500 kΩ according to the difference of the capacitance value of variable capacity means 3. Fixed resistors, for example, chip resistors are used as resistor 7*s* and resistor 7*b*.

Next, a method of manufacturing tunable antenna module 1 is explained in detail.

First of all, the average electrostatic capacity of variable capacity means 3 of each production lot is calculated by sampling variable capacity means 3 of each production lot of variable capacity means 3, measuring the electrostatic capacity of each variable capacity means 3 and averaging those measurement values.

Next, a production lot of variable capacity means 3, of which average electrostatic capacity is as predetermined, from other production lots of variable capacity means 3, of which average electrostatic capacity is not as predetermined, is discriminated. And, a drift X (%) of average electrostatic capacitances between variable capacity means 3 in production lots, of which average electrostatic capacity is as predetermined, and variable capacity means 3 in other production lots, of which average electrostatic capacity is not as predetermined, are calculated by using formula (1).

$$X=[(\text{Average electrostatic capacity of variable capacity means of each of production lots})-(\text{Average electrostatic capacity predetermined for variable capacity means})]\times 100/(\text{Average electrostatic capacity predetermined for variable capacity means}) \quad (1)$$

A resistance value r1 is calculated by applying the resistance value r0 of resistor 7*s*, the resistance R0 of resistor 7*b*, and said drift x in average electrostatic capacitances to formula (2).

$$r1=r0+R0\times(x/100) \quad (2)$$

Finally, tunable antenna module 1 of FIG. 1 is manufactured by using resistor 7*s* set to the resistance value of r1, resistor 7*b* set to the resistance value of R0, and variable capacity means 3 of which electrostatic capacity characteristics is not as predetermined.

The operation of this embodiment is explained referring to an example which uses VCD as variable capacity means 3.

In tunable antenna module 1, the capacity of VCD (variable capacity means 3) is changed by a frequency control voltage of frequency control source 6, the tuning frequency is changed according to the frequency of the electric wave received by wave receiving element 2. As a result, broadcasting in the desired channel is received. The electric wave received by wave receiving element 2 is transmitted from feeding part 2*d* to an amplifier (not shown) and a receiver circuit (not shown) as a received signal.

To receive broadcasting in a channel of the high frequency band, it is required to reduce the electrostatic capacity of VCD by increasing the tuning frequency, that is, raising the frequency control voltage of frequency control source 6. While, to receive broadcasting in a channel of the low frequency band, the frequency control voltage is lowered oppositely to increase the electrostatic capacity of VCD.

Figure 7:
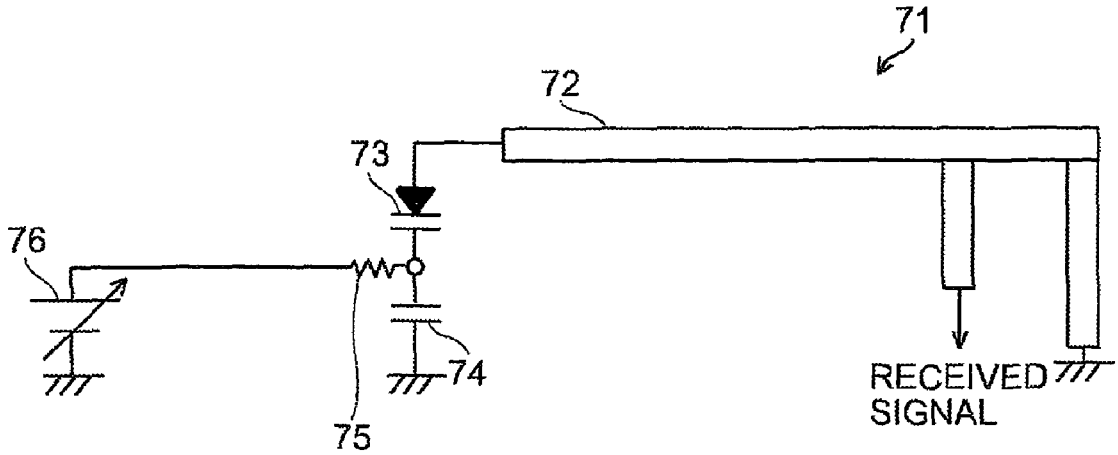
FIG. 7 is a circuit diagram of a conventional tunable antenna module.
Figure 8:
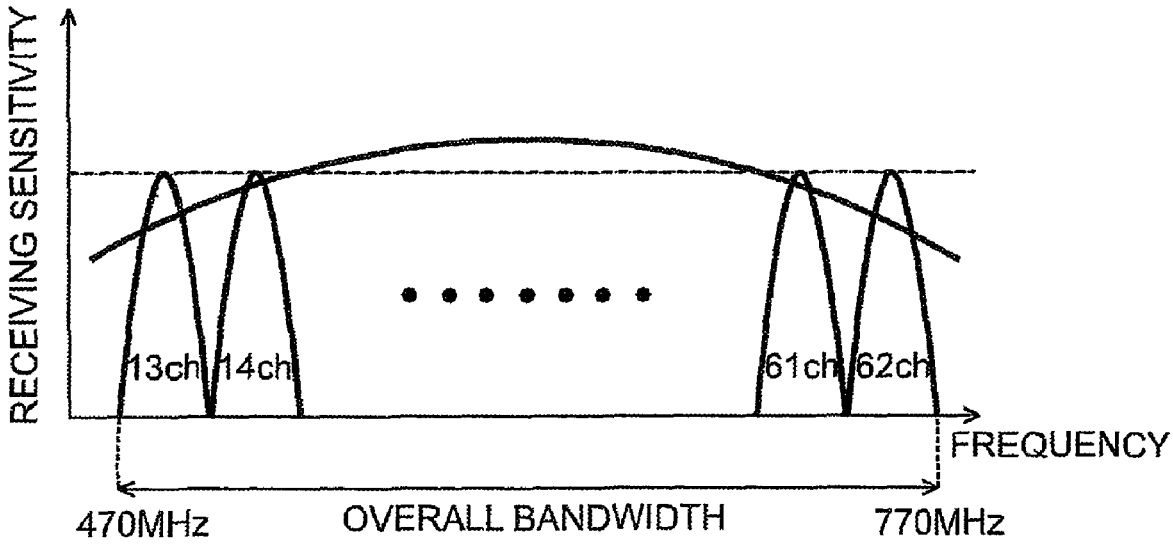
FIG. 8 is a view showing an antenna gain characteristic of a monopole antenna generally used in the digital terrestrial broadcasting in Japan.

At this time, when the electrostatic capacity characteristic of VCD 73 varies, the tuning frequency varies similarly in conventional tunable antenna module 71 shown in FIG. 7.

However, voltage divider circuit 7 can amend the tuning frequency by connecting voltage divider circuit 7, which divides the frequency control voltage between frequency control source 6 and variable capacity means 3 in tunable antenna module 1.

In a word, the frequency control voltage applied to VCD is divided by voltage divider circuit 7 in a tunable antenna module 1 and the frequency control voltage divided are applied to VCD even when the average value of capacity shifts to a low direction or a high direction due to the difference in characteristic of the electrostatic capacity of VCD. Therefore, the tuning frequency does not shift greatly because it is adjusted that the capacitance value of VCD reaches the desired value.

As a result, tunable antenna module 1 can operate VCD anytime with the constant voltage-electrostatic capacity characteristic maintained. Namely, it has the function of frequency amendment that the difference of antenna characteristics such as the tuning frequency etc. can be reduced.

For instance, when voltage divider circuit 7 is composed of resister 7*s* of 50 kΩ and resistor 7*b* of 500 kΩ, the frequency control voltage can be decreased by 10% within the range necessary for reception to improve or maintain the receiving characteristics.

Moreover, when resistor 7*s* is set to 0 kΩ (short-circuited) and voltage divider circuit 7 is composed of resistor 7*b* of 500 kΩ, the drift which becomes smaller than the average capacitance value of VCD in production lot can be somewhat amended as described later, and frequency control source 6 also becomes steady.

Therefore, the drift of the tuning frequency due to the difference of the applied voltage-electrostatic capacity characteristic of VCD can be reduced by tunable antenna module 1.

It is usually necessary to change the applied voltage data of each device and carry out the feedback control by using a microcomputer in order to amend the drift of the tuning frequency. Measures to prevent the tuning frequency from shifting only by the antenna module becomes possible according to tunable antenna module 1 according to this embodiment, and the change in hardware on the antenna module side is not required. It is, therefore, possible to curbs cost.

Moreover, tunable antenna module 1 of FIG. 1 can be easily made according to a manufacturing method of this embodiment.

Here, an example of mounting the main part of tunable antenna module 1 (voltage divider circuit and tuning circuit) is explained.

Figure 2:
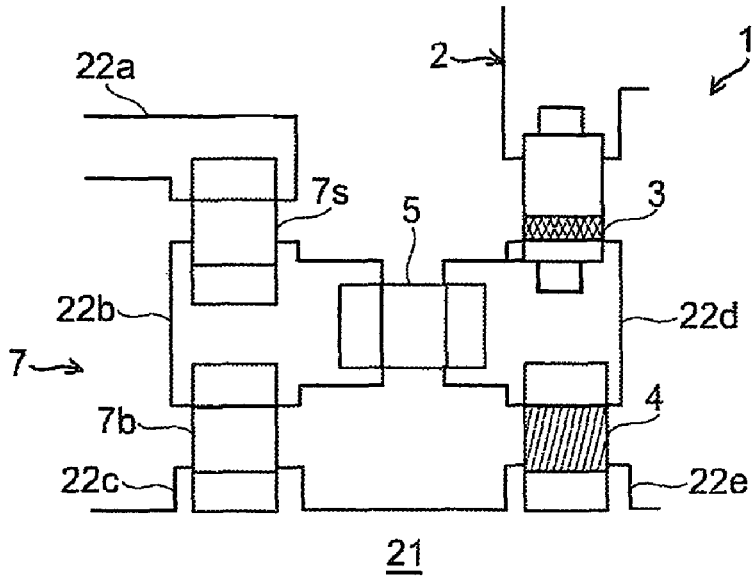
FIG. 2 is a plan view showing an example of mounting of the principal part of the tunable antenna module with frequency correction circuit shown in FIG. 1.

Circuit patterns 22*a*-22*e* mutually insulated are formed on printed circuit substrate 21 as shown in FIG. 2 to compose tunable antenna module 1.

Circuit pattern 22*a* is wiring to connect a positive terminal of frequency control source 6 (FIG. 1) and a power supply side terminal of resistor 7*s*. Circuit pattern 22*b* is wiring to connect between resistor 7*s* and resistor 7*b*, and a node of resistor 7*s* and resistor 7*b* and a power supply side terminal of resistor 5 for cutting off an RF. Circuit pattern 22*c* is wiring to connect an earth side terminal of resistor 7*b* and GND (ground) of printed circuit substrate 21. Circuit pattern 22*d* is arranged to oppose to circuit pattern 22*b*, and wiring to connect between VCD (variable capacity means 3) and capacitors 4 for cutting off a DC, and a node of VCD and capacitor 4 for cutting off a DC and a wave receiving element side terminal of resistor 5 for cutting off an RF. And, Circuit pattern 22*e* is wiring to connect an earth side terminal of capacitor 4 for cutting off a DC and GND of printed circuit substrate 21.

Resistor 7*s*, resistor 7*b*, resistor 5 for cutting off an RC, capacitor 4 for cutting off a DC and VCD are soldered in random order to mount them on a fixed position of each circuit pattern 22*a*-22*e* on printed board 21 by using a mounting device such as a chip mounter. VCD and wave receiving element 2 are connected to each other to obtain tunable antenna module 1 shown in FIG. 1.

Figure 3:
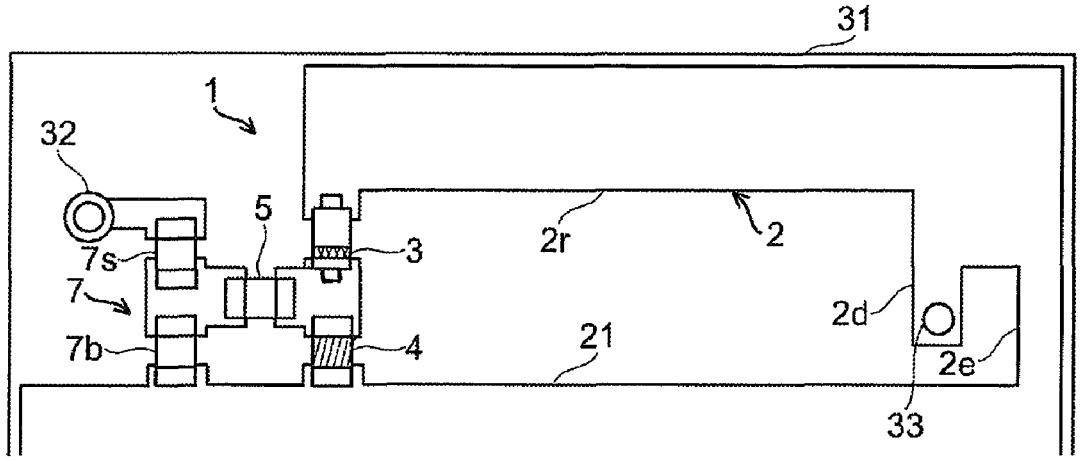
FIG. 3 is a plan view showing an example of mounting of the tunable antenna module with frequency correction circuit shown in FIG. 1.

Mounting of tunable antenna module 1 on a computer or mobile and portable equipment is carried out as follows. Printed board 21 is mounted at a distant from one end of housing 31 as shown in FIG. 3, and tunable antenna module 1 is mounted on one end of printed board 21.

In that case, positive terminal 32 (FIG. 3) to connect with frequency control source 6 (FIG. 1) is formed at the edge opposite to the side where resistor 7*s* of circuit pattern 22*a* is mounted, and received signal output terminal 33 (FIG. 3) to connect with a coaxial cable (not shown) of minute diameter and printed circuit substrate 21 is formed on the point of feeding part 2*d* of wave receiving element 2.

The MEMS (Micro Electro Mechanical System) variable capacity may be used as variable capacity means 3 though an example where VCD is used as variable capacity means 3 has been explained in the above-mentioned embodiment. The drift of the tuning frequency due to difference can be reduced according to tunable antenna module 1 of this embodiment for the same reason as the above-mentioned though there is a difference of the applied voltage-electrostatic capacity characteristic also in the MEMS variable capacity.

Especially, tunable antenna module 1 manufactured according to this embodiment by using the MEMS variable capacity can be used as not only a reception antenna but also a transmission antenna because the MEMS variable capacity is different from VCD which consists of a semi-conducting material.

The reason is as follows. VCD cannot be used as a transmission antenna used for an RF signal of a comparatively high frequency because an output radio frequency becomes nonlinear when the radio frequency signal of a comparatively high frequency (about 100 MHz or more) is input to VCD. However, the MEMS variable capacity can be used as a transmission antenna because the output radio frequency has linear characteristic for an RF input signal of a comparatively high frequency.

Moreover, it is possible to use a Cu foil pattern for laser trimming as resistor 7*s* and resistor 7*b* though an example which uses fixed resistors as resistor 7*s* and resistor 7*b* which composes voltage divider circuit 7 has been explained in the above-mentioned embodiment.

In this case, the Cu foil is formed on the printed circuit substrate, the resistance of the Cu foil is measured by using a tester, and the Cu foil is trimmed by a laser or an insulator is formed on the Cu foil after trimming as becoming resistance set in resistor 7*s* and resistor 7*b* based on the measured resistance. As a result, voltage divider circuit 7 can be formed in line.

Next, an example which uses tunable antenna module 1 for a cellular phone is explained. Here, the MEMS variable capacity was used as variable capacity means 3 to use tunable antenna module 1 as an antenna for transmitting and receiving.

Figure 4:
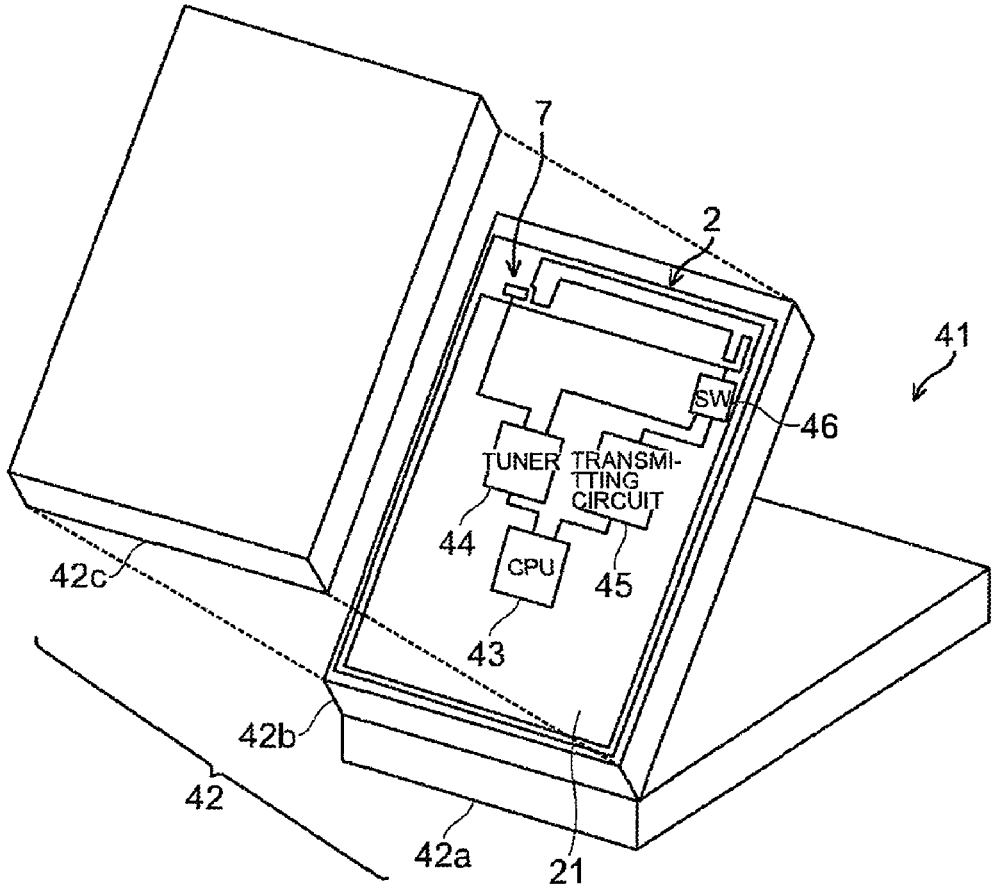
FIG. 4 is an exploded perspective view showing the tunable antenna module with frequency correction circuit shown in FIG. 1, used for a cellular phone.

Cellular phone has case 42 installed to freely open/close and to fold into two by turning means such as a hinge as shown in FIG. 4.

Case 42 comprises battery side case 42*a* in which a battery used also for frequency control source 6 (FIG. 1) is built in, LCD side case 42*b* where printed circuit substrate 21 and tunable antenna module 1 are built in, which exists on the other side of battery side case 42*a*, and back cover 42*c* attached to LCD side case 42*b* to cover printed circuit substrate 21 and tunable antenna module 1. Where, liquid crystal display (LCD) is housed in battery side case 42*a*. Wave receiving element 2 of tunable antenna module 1 operates as a radiating element of an antenna element at the transmission.

Printed circuit substrate 21 has CPU 43 to be connected with the battery; tuner 44 connected with CPU 43; transmitting circuit 45 connected with CPU 43; transmitting and receiving switch (SW) connected independently with receiving parts of transmitting circuit 45, and wave receiving element 2 (transmission parts in case of a radiating element) respectively, which switches tuner 44 and transmitting circuit 45 by a switching signal from CPU 43.

Tuner 44 generally has an amplifier for reception, a high frequency circuit, and a demodulator, etc. to receive an electric wave, excluding a tuning circuit. To transmit the electric wave, transmitting circuit 45 generally has a necessary frequency generator, an amplifier for transmission, a modulator, and a power amplifier, etc. for transmission.

In case that one segment broadcasting is received in cellular phone 41, CPU 43 outputs a switch signal to SW 46 through tuner 44, and SW 46 switches CPU 43 to a reception side circuit when the desired channel is selected by operating buttons.

On the other hand, CPU 43 outputs a control signal corresponding to a tuning frequency of the selected channel to frequency control source 6 (FIG. 1) of tunable antenna module 1 through tuner 44, and applies a constant frequency control voltage corresponding to the channel selected by frequency control source 6 to variable capacity means 3 (FIG. 1) through voltage divider circuit 7.

The electric wave received by wave receiving element 2 is input from feeding part 2*d* to tuner 44 as a received signal through SW 46, and an image is displayed in LCD. When an electric wave is transmitted, almost opposite operation to the above-mentioned operation is performed through transmitting circuit 45.

Thus, if tunable antenna module 1 is used, low-cost cellular phone 41 can be obtained without making a change in hardware on the cellular phone side.

Embodiments

Voltage divider circuit 7 which consists of resistor 7*s* and resistor 7*b* was formed before making tunable antenna module 1. First of all, some variable capacity means 3, VCDs were sampled at three production lots, production lot A (for mounting on tunable antenna module 1 of embodiment 1), production lot B (for mounting on tunable antenna module 1 of embodiment 2) and each production lot C (for mounting on tunable antenna module 1 of embodiment 3), and then electrostatic capacity of each of variable capacity means 3 sampled was measured.

Figure 5:
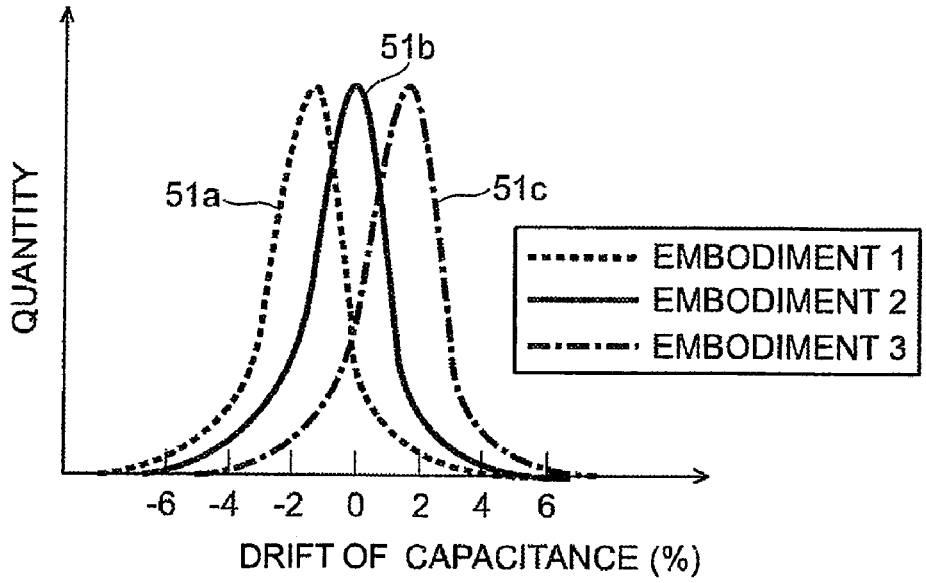
FIG. 5 is a view showing difference characteristics of a variable capacitance diode in the embodiment.

FIG. 5 is a graph showing the relationship between capacitance values of VCD and numerical quantity of VCD which shows the same capacitance value each production lot of VCD. Abscissa axis was standardized by using formula (3) so that the drift of the capacitance value may become 0% when VCD became the desired capacitance value.

$$\text{(drift of capacitance value)}=\{\text{(capacitance value measurement result of each VCD)}-\text{(desired capacitance value of VCD)}\}\times 100/\text{(desired capacitance value of VCD)} \quad (3)$$

Characteristic lines 51*a*-51*c* of {drift (%) from the average capacitance value (peak value) of VCD sampled}−quantity (number)} almost show normal distribution in embodiments 1-3 as shown in FIG. 5.

The following is understood from each of characteristic lines 51*a*-51*c*. In embodiment 2, the drift from the desired capacitance value is the fewest (0%). The drift (drift of the average capacity) of the capacitance value obtained by averaging the measurement results in embodiment 1 shows a value smaller than that of embodiment 2 by −2%. Moreover, The drift (drift of the average capacity) of the capacitance value obtained by averaging the measurement results in embodiment 3 shows a value larger than that of embodiment 2 by +2%. In addition, it is understood that the drift from the average capacitance value is within ±2% in almost all VCDs of each of production lots A-C.

Then, the resistance of resistor 7*s* as the adjusting resistor was set as shown in Table 1 so that the C−V characteristics should not become a nonlinear region based on the sampling value which had been obtained in each of characteristic lines 51*a*-51*c* after having fixed the resistance of resistor 7*b* to 500 kΩ.

TABLE 1

| | Drift of capacitance value | Value of adjusting resistor |
|---|---|---|
| Embodiment 1 (Lot A) | −2% | 0 Ω |
| Embodiment 2 (Lot B) | 0% | 10 kΩ |
| Embodiment 3 (Lot C) | +2% | 20 kΩ |

As shown in Table 1, the resistance of resistor 7*s* was set to 0Ω in embodiment 1, 10 kΩ in embodiment 2 and 20 kΩ in embodiment 3. Afterwards, each resistor 7*s* of embodiments 1-3 was built into printed circuit substrate 21, and voltage divider circuit 7 was assembled and mounted. As a result, tunable antenna module 1 mounted was made as shown in FIG. 2. Moreover, conventional tunable antenna modules 71 mounted as shown in FIG. 7 were made by using the same VCDs as ones used for embodiments 1-3 as comparative examples 1-3, respectively.

Figure 6:
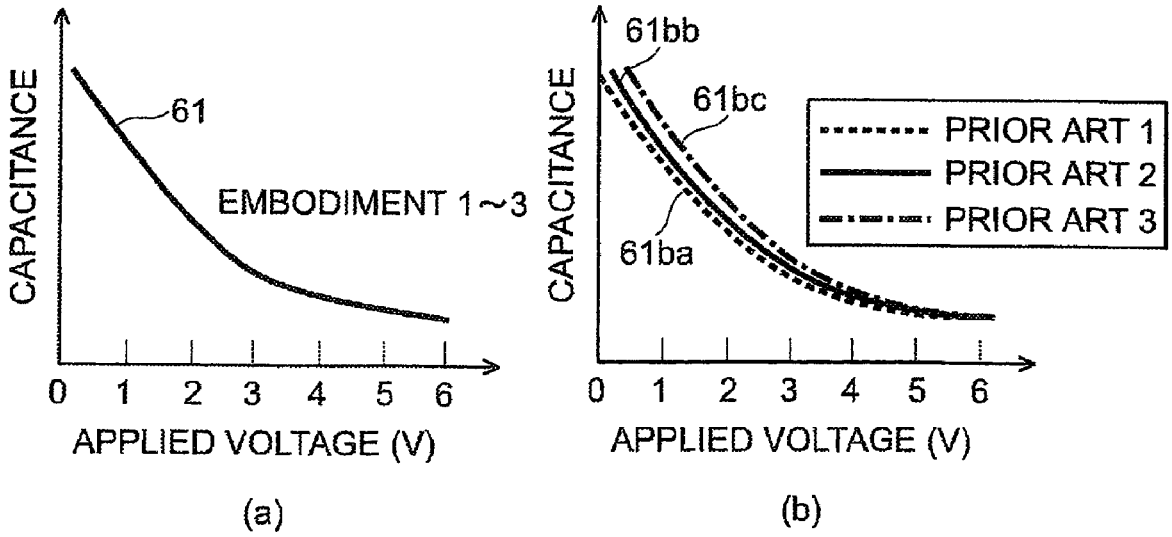
FIG. 6(*a*) is a view showing an applied voltage-electrostatic capacity characteristic of a variable capacitance diode after the amendment of the divided voltage in the embodiment, and FIG. 6(*b*) is a view showing an applied voltage-electrostatic capacity characteristic of a variable capacitance diode in the prior art.

In conventional tunable antenna module 71 of each of examples 1-3 as seen from characteristic lines 61*ba*-61*bc* of the applied voltage-electrostatic capacity of VCD shown in FIG. 6(*b*), the applied voltage-electrostatic capacity characteristic of VCD varied especially in the region of a low applied voltage corresponding to a low frequency band because the difference of the average capacitance values of VCDs in production lots is reflected.

On the other hand, in tunable antenna module 1 of the embodiments 1-3, as shown in characteristic line 61 of the applied voltage-electrostatic capacity of FIG. 6(*a*), the applied voltage-electrostatic capacity characteristic of VCD after the amendment was constant without reflecting the difference of the average capacitance values of VCDs in production lots in the region of a low applied voltage corresponding to a low frequency band. Therefore, the difference of the antenna characteristics such as a tuning frequency etc. could be reduced according to embodiments 1-3.

Here, a method of adjusting the frequency control voltage applied to VCD of tunable antenna module 1 is explained.

First of all, resistance r0 of resistor 7*s*, resistance R0 of resistor 7*b* capacitance value, and capacitance value (The drift of the average capacity is 0%) of VCD mounted on tunable antenna module 1 which becomes a standard are decided.

In case that tunable antenna module 1 whose VCD has the drift of x % from the desired average capacitance value is made, the resistance of resistor 7*s* is changed to resistance r1 calculated by applying each of the above-mentioned values to formula (2) mentioned above after drift x(%) of the average capacitance value is calculated by formula (1) mentioned above.

As a result, because the voltage value after the divided voltage of the frequency control voltage applied to VCD is optimized, and the desired capacitance value of VCD is obtained, the tuning frequency does not vary even in tunable antenna module 1 which uses VCD whose average capacitance value is drifted.

Although the present invention has been illustrated and described with respect to exemplary embodiment thereof, it should be understood by those skilled in the art that the foregoing and various other changes, omission and additions may be made therein and thereto, without departing from the spirit and scope of the present invention. Therefore, the present invention should not be understood as limited to the specific embodiment set out above but to include all possible embodiments, which can be embodied within a scope encompassed and equivalent thereof with respect to the feature set out in the appended claims.

What is claimed is:

1. A tunable antenna module with frequency correction circuit comprising: an antenna element, a variable capacity means connected to said antenna element, and a frequency control source that generates a controlling voltage for varying the capacity of said variable capacity means to vary a tuning frequency according to the frequency of radio wave received by said antenna element, further comprising;

a voltage divider circuit comprised of a plurality of resistors for dividing said controlling voltage, and connected between said frequency control source and said variable capacity means; said tuning frequency being corrected by said voltage divider circuit.

2. The tunable antenna module with frequency correction circuit according to claim 1, wherein said voltage divider circuit includes circuitry comprised of:

a series connection of a first resistor having a power supply terminal thereon and a second resistor having a grounding terminal thereon, a value of resistance of said second resistor being larger than that of said first resistor;

a connection of said power supply terminal of said first resistor to said frequency control source;

a connection of said grounding terminal of said second resistor to ground; and a parallel connection of said variable capacity means to the intermediate connection point of said series connection of said first resistor and said second resistor.

3. The tunable antenna module with frequency correction circuit according to claim 2, wherein values of resistances of said first and second resistors are determined according to C-V characteristics of said variable capacity means.

4. The tunable antenna module with frequency correction circuit according to claim 3, wherein resistance values of said first and second resistors are determined based on a sample value obtained by sampling said variable capacity means in each production lot of said variable capacity means, measuring electrostatic capacity of said sampled variable capacity means, and averaging values measured.

5. The tunable antenna module with frequency correction circuit according to claim 1, wherein said variable capacity means is comprised of a variable capacitance diode or a MEMS variable capacitor (a micro-electromechanical system variable capacitor).

6. The tunable antenna module with frequency correction circuit according to claim 1, wherein said resistor is a fixed resistance or a copper foil pattern for trimming.

7. A method of manufacturing a tunable antenna module with frequency correction circuit comprising:

an antenna element;

a variable capacity means electrically connected to said antenna element;

a frequency control source that generates controlling voltage for varying the capacity of said variable capacity means;

a voltage divider circuit that includes said voltage divider circuit includes a circuitry comprised of a series connection of a first resistor having a power supply terminal thereon and a second resistor having a grounding terminal thereon, wherein a value of resistance of said second resistor is larger than that of said first resistor, a connection of said power supply terminal of said first resistor to said frequency control source, a connection of said grounding terminal of said second resistor to ground, and a parallel connection of said variable capacity means to the intermediate connection point of said series connection of said first resistor and said second resistor; which comprises the steps of:

sampling said variable capacity means from each production lot of said variable capacity means;

measuring electrostatic capacity of said sampled variable capacity means;

averaging measurements obtained in said measuring to calculate an average electrostatic capacity of said variable capacity means for each of said production lots;

discriminating a production lot of said variable capacity means, of which average electrostatic capacity is as predetermined, from other production lot of said variable capacity means, of which average electrostatic capacity is not as predetermined;

calculating a drift X (%) of average electrostatic capacitances between said variable capacity means in said production lot, of which average electrostatic capacity is as predetermined, and said variable capacity means in said other production lot, of which average electrostatic capacity is not as predetermined, using formula (1);

$$X=[(\text{Average electrostatic capacity of variable capacity means of each of production lots})-(\text{Average electrostatic capacity predetermined for variable capacity means})]\times 100/(\text{Average electrostatic capacity predetermined for variable capacity means}) \quad (1)$$

calculating a resistance value r1 by applying the resistance value of said first resistor r0, the resistance of said second resistor R0, and said drift x in average electrostatic capacitances to formula (2); and $$r1=r0+R0\times(x/100) \quad (2)$$

wherein said tunable antenna module is manufactured by using said first resistor of which resistance value is said calculated resistance value of r1, said second resistor of which resistance value is said resistance value R0, and said variable capacity means of which electrostatic capacity characteristics is not as predetermined.

* * * * *